US006775911B2

(12) United States Patent
Tremblay

(10) Patent No.: US 6,775,911 B2
(45) Date of Patent: Aug. 17, 2004

(54) CUTTING DEVICE WITH RETRACTABLE BLADE

(75) Inventor: Gérard Tremblay, Biganos (FR)

(73) Assignee: Societe Mure & Peyrot, Bordeaux Cedex (FR)

( * ) Notice: Subject to any disclaimer, the term of this patent is extended or adjusted under 35 U.S.C. 154(b) by 100 days.

(21) Appl. No.: 10/189,501

(22) Filed: Jul. 8, 2002

(65) Prior Publication Data

US 2003/0019109 A1 Jan. 30, 2003

(30) Foreign Application Priority Data

Jul. 6, 2001 (FR) ..... 01 09068

(51) Int. Cl.[7] ..... B26B 1/08
(52) U.S. Cl. ..... 30/162; 30/335
(58) Field of Search ..... 30/162, 320, 335

(56) References Cited

U.S. PATENT DOCUMENTS 3,999,290 A * 12/1976 Wood ..... 30/2
6,044,562 A 4/2000 Dillenbeck ..... 30/162
6,148,520 A 11/2000 Berns ..... 30/2
6,161,290 A * 12/2000 Takamasa ..... 30/162
6,550,144 B1 * 4/2003 Berns ..... 30/162
6,553,673 B2 * 4/2003 Peyrot et al. ..... 30/162

FOREIGN PATENT DOCUMENTS

FR 2 810 574 12/2001

* cited by examiner

*Primary Examiner*—Hwei-Siu Payer
(74) *Attorney, Agent, or Firm*—Young & Thompson

(57) ABSTRACT

The invention relates to a cutting device with a retractable blade comprising a blade and a sleeve into which it is adapted to be retracted. It comprises: a support (16) for the blade (12), having a drive abutment (36), adapted to slide along the axis of the sleeve (10), first resilient return (19); a controllable movement (26) mounted on sleeve (10), adapted to coact with the support means (16) and abutment means adapted to receive said support means (16) of the blade (12) in a second working position to block them in translation.

13 Claims, 2 Drawing Sheets

CUTTING DEVICE WITH RETRACTABLE BLADE

The present invention relates to a cutting device with a retractable blade, comprising a blade and a sleeve into which it is adapted to be retracted.

Cutting devices with retractable blades comprising a blade sliding in a sleeve with a slideway, are well known. For example, instruments of this type, called cutters, permit cutting paper, cardboard or any other material generally in the form of sheets or plates.

The blades used in these devices are very sharp to ensure effective cutting and they are generally interchangeable so as to maintain a completely operable instrument. Thus, these instruments are relatively dangerous and numerous accidents take place during use. Conventionally, the user must exert a strong pressure on the sleeve of the instrument and give it a rapid movement to obtain a clean cut of the material to be cut. Thus, when the contact of the blade with the material stops, the user must also stop moving said instrument with as much energy as what was necessary for cutting. However, generally, accidents take place when the contact of the blade with the material stops and, while still applying force, the user brings the blade toward himself.

A problem which arises and which the present invention seeks to solve, is thus to provide a cutting device with a retractable blade in which the blade retracts into the sleeve before a clumsy user can bring it toward himself or toward anyone else.

To this end, the present invention provides a cutting device with a retractable blade, comprising: blade support means, having means forming a drive abutment, adapted to slide along the axis of said sleeve between a first rest position in which the blade is retracted and a first working position in which the blade is extended beyond said sleeve, said support means being in said first working position, adapted to be brought from a second rest position to a second working position, spaced from the axis of said sleeve, by passing through a second intermediate position; first resilient return means adapted to hold said blade support means in said first rest position; controllable movement means mounted on said sleeve, adapted to coact with said support means and to bear against said drive abutment means to drive said blade support from said first rest position toward said first working position; abutment means adapted to receive said blade support means in said second working position to block them in translation; and the drive of the blade by means of said sleeve against a surface to be cut involving said support means in said second working position and giving rise to the disengagement of said controllable movement means engaged in said drive abutment forming means such that said resilient return means drive said blade support means into said first rest position as soon as the blade is no longer in contact with said surface and said abutment means free said blade support means which are brought from said second working position toward said second intermediate position.

Thus, a characteristic of the cutting device according to the invention, resides in the manner of coaction of the blade support means with the controllable movement means and with the abutment means, permitting simultaneously blocking the blade support means in translation in the second working position and the disengagement of the controllable movement means engaged in the means forming a drive abutment. In this way, as soon as the blade is no longer in contact with the surface to be cut, the abutment means free the blade support means which, driven by the resilient return means, return to the first rest position in which the blade is completely retracted into the sleeve. Thanks to this characteristic, the user of the device cannot wound himself because the blade retracts when it leaves the surface to be cut.

In a particularly advantageous way, said blade support means, having an upper portion and a lower portion, extend longitudinally and comprise a first end in which the blade is held in prolongation of said blade support means, an intermediate portion comprising said drive abutment forming means, and a second guide end for said support means. In this way, the blade support means are adapted to be guided in translation in the sleeve along their longitudinal axis between the rest position and the working position with the controllable movement means which are applied to the intermediate portion.

Preferably, the drive abutment means are constituted by two means forming lugs disposed on the lateral surface of said intermediate portion in its lower portion, opposite each other and whose abutment surface is substantially perpendicular to said support means. Thus, the lug forming means constitute stop points perpendicular to the longitudinal axis of the blade support means against which the controllable movement means bear when they are controlled in translation.

According to a preferred characteristic, said controllable movement means have a first portion projecting outside the sleeve to control them, and a second portion divided into two symmetrical branches facing each other, adapted to overlap said upper portion at least in said intermediate portion and said first end, the branches being adapted to bear against the abutment surfaces of the lug forming means. In this way, when the controllable movement means are driven in translation, the branches bear against the lug forming means and drive the blade support means toward said first working position in which the blade is outside the sleeve.

It will be understood that the second portion of the controllable movement means, thus necessarily permit the passage of the first end of the blade support means and hence of the blade such that they retract under the influence of the resilient means when the controllable movement means are held in the working position.

Preferably, said branches of said second portion of said controllable movement means are inclined relative to each other and relative to a plane of symmetry which separates them, and the side walls of said upper portion of said intermediate portion constitute frictional regions against which the branches are adapted to be applied to be spaced from each other when said blade support means are driven toward said controllable movement means, and to disengage from said lug forming means. Thus, the second portion of the controllable movement means provides a flared fork whose internal wall of the branches, at least in their medial portion, comes to bear against the upper sidewalls of the intermediate portion. Moreover, the end of the branches is adapted to be engaged in the means forming a drive abutment located in the lower portion of the intermediate portion, when the blade support means are in the first working position. In this way, the movement of the blade support means, substantially perpendicular to their longitudinal axis and toward the summit of the fork in which the branches come together, gives rise to the spacing of the branches of the fork and the release of the lug forming means. This situation takes place when the blade is applied against the surface to be cut after having driven the controllable movement means and as a result the blade support means. These latter are thus brought to said second working position.

According to an advantageous feature, the second portion of said controllable movement means between the branches of which said upper portion of said intermediate portion is adapted to be engaged, constitutes said abutment means adapted to block said blade support means in said second working position. Thus, when the blade is applied against the surface to be cut and the controllable movement means are held in their working position, the upper sidewalls of the intermediate portion come to nest between the branches of the fork and space them, but they also permit, as will be explained in detail in what follows, the blockage in translation of the blade support means relative to the controllable movement means.

It will be understood that when the application of the blade against the surface to be cut stops, the branches of the fork tend to tighten and to remove the blade support means. In this way, the blockage in translation stops and the blade support means are practically freed in translation.

Preferably, said first resilient return means is constituted by a helicoidal spring, which drives the blade support means to the rest position when it is freed relative to the fork.

Preferably, the device moreover comprises second resilient return means adapted to hold said controllable movement means in a rest position.

According to a preferred embodiment, the blade support means and the controllable movement means are adapted to be formed by molding.

Other characteristics and advantages of the invention will become apparent from a reading of the description given hereafter, of particular embodiments of the invention, given as an indication but not a limitation, with reference to the accompanying drawings, in which.

Figure 1:
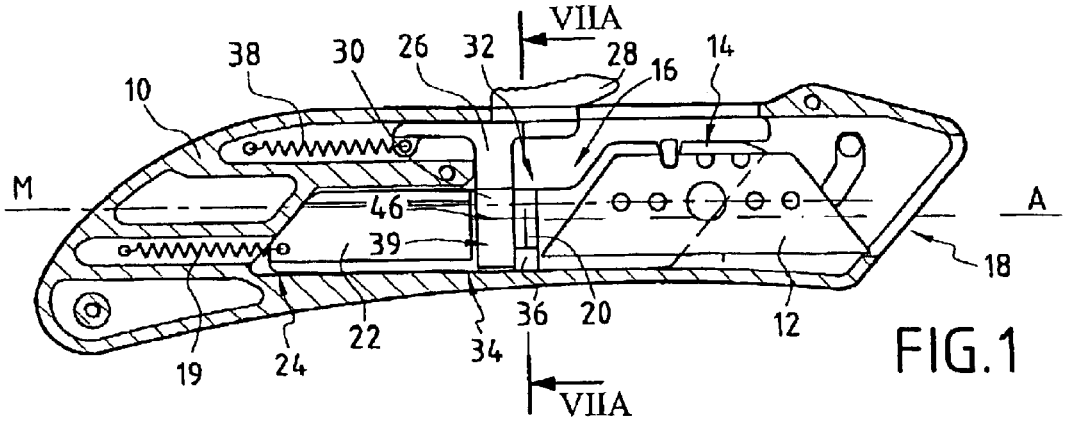
FIG. 1 is a cross-sectional view of a cutting device according to the invention in a first rest position.
Figure 5:
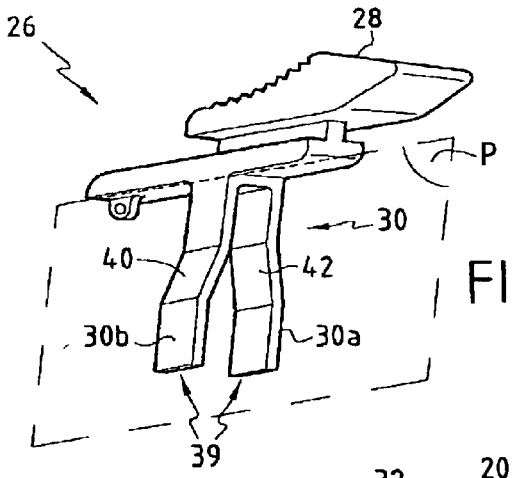
FIG. 5 is a detailed perspective view of particular means of the device shown in the preceding figures.
Figure 6A:
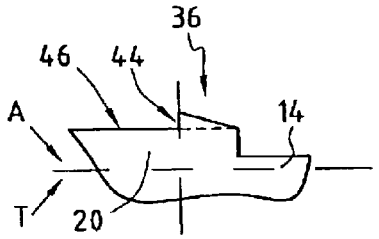
FIG. 6A is a detailed view from below of the other particular means shown in FIG. 6.

There will first of all be described, with reference to FIG. 1, the essential constituent elements of the device according to the invention and their arrangement, to describe thereafter their particular structures with reference to FIGS. 5, 6A and 6B. Then, there will be described the general operation of the cutting device with reference to the other figures.

There will now be described, first of all, with reference to FIG. 1, the essential constituent elements of the device according to the invention and their arrangement, after which will be described their particular structure with reference to FIGS. 5, 6A and 6B. Then, there will be described the general operation of the cutting device with reference to the other figures.

FIG. 1 shows a cutting device according to the invention in a rest condition. It is constituted by a sleeve 10 and a blade 12 retracted into the sleeve 10. The blade 12 is mounted at the end 14 of blade support means 16, a blade carrier, which extend longitudinally along the axis A. The blade carrier 16 is adapted to slide within the sleeve 10 along its longitudinal axis A to cause the blade 12 to leave the open end 18 of the sleeve 10 and it is maintained in a first rest position, as shown in FIG. 1, by a helicoidal spring 19. Moreover, the blade carrier 16 has an intermediate portion 20 and a second guide end 22, permitting both guiding in translation of the blade carrier 16 and holding of the blade 12 relative to the sleeve 10. To do this, the sleeve has a longitudinal recess 24, oriented toward the open end 18 of the sleeve 10, in which is inserted the blade carrier 16 so as to guide it in translation.

The cutting device comprises controllable movement means 26, having a first portion 28, or cursor, projecting from the sleeve 10 and a second portion 30 divided into two symmetrical branches which will be described hereinafter in the description and which straddle the upper portion 32 of the blade carrier 16 to extend to a position facing the lower portion 34 of the blade carrier 16. As shown in FIG. 1, in this rest position, the second portion 30 is located facing the intermediate portion of the blade carrier 16. Moreover, the lower portion 34 of the blade carrier 16 has, in the intermediate portion 20, means forming a drive abutment 36 which will also be described hereafter.

The controllable movement means are shown in FIG. 1 in their rest position and are adapted to be moved parallel to the sleeve 10 on which they are mounted and substantially parallel to the longitudinal axis A of the blade carrier 16. Moreover, they are held in their rest position by a helicoidal spring 38.

Referring now to FIG. 5 to describe the controllable movement means 26, there will be seen in this figure controllable movement means 26 comprising the first portion 28 forming a cursor, adapted to be driven by the fingers of the hand and the second portion 30 divided into two symmetrical legs 30*a* and 30*b* relative to a plane P and relative to each other. It will be understood that the first portion 28 is located beyond the sleeve 10 and that the second portion 30 is inserted into the sleeve 10.

The branches 30*a* and 30*b* each have an end 39 and an intermediate portion 40 and 42 inclined relative to each other and relative to the plane P which separates them, such that the second portion 30 forms a substantially flared fork. Moreover, the branches 30*a* and 30*b* are resiliently movable relative to each other perpendicularly to the plane P and more particularly, they are adapted to be moved apart from each other and to return to their initial position when the force is relieved. This characteristic is achieved by making the controllable movement means 26 of plastic material, for example polyamide.

The controllable movement means 26 coact with the blade support means 16 or blade carrier, that is shown in perspective in FIG. 6 and which will now be described in greater detail.

The first end, having no blade, is prolonged by the intermediate portion 20, itself prolonged by the second guide end 22. The intermediate portion 20 comprises means forming a drive abutment 36, located in the lower portion 34 of the sidewall of the blade carrier 16. Obviously, identical means 36 forming a drive abutment are located symmetrically on the opposite sidewall. In FIG. 6A, a detailed view from below, there is shown means forming a drive abutment 36 secured to the intermediate portion 20 which itself is prolonged by the first end 14. The means 36 forming an abutment constitute a lug whose bearing surface 44 is substantially perpendicular to the longitudinal axis A of the blade support 16. Moreover, the lug 36 is located against the lateral surface of the intermediate portion 20, adjacent the edge that the first end 14 prolongs. In this way, the intermediate portion 20 has a side bearing surface 46, against which a branch 30*b* of the second portion 30 of the controllable movement means is adapted to be applied.

Figure 6:
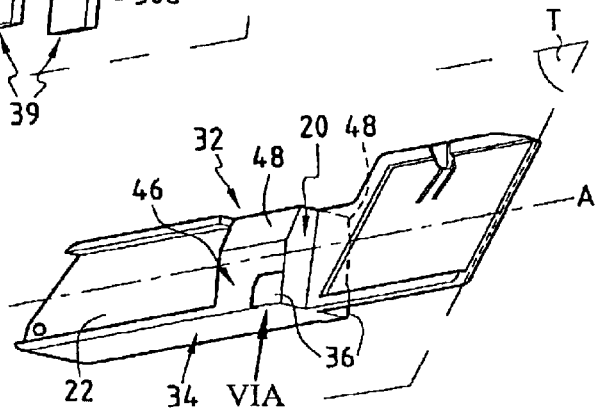
FIG. 6 is a detailed perspective view of other particular means of the device shown in FIGS. 1, 2, 3 and 4.

In a completely symmetrical way, relative to the plane T of symmetry of the blade carrier 16, a lug 36 and a bearing surface are located against the other lateral surface, which does not appear in FIG. 6.

There is also shown in FIG. 6 the second end 22, which prolongs the intermediate portion, with a profile of the type "IPE" so as to rigidify it and to facilitate guidance. Moreover, the lateral walls of said upper portion 32 of said intermediate portion 20 are slightly truncated so as to form inclined surfaces 48 symmetrical to the plane T, on each side of the blade carrier 16. These inclined surfaces 48 constitute frictional zones against which the branches are adapted to be applied, as will be explained in the description that follows with reference to FIGS. 7A and 7B.

Figure 7A:
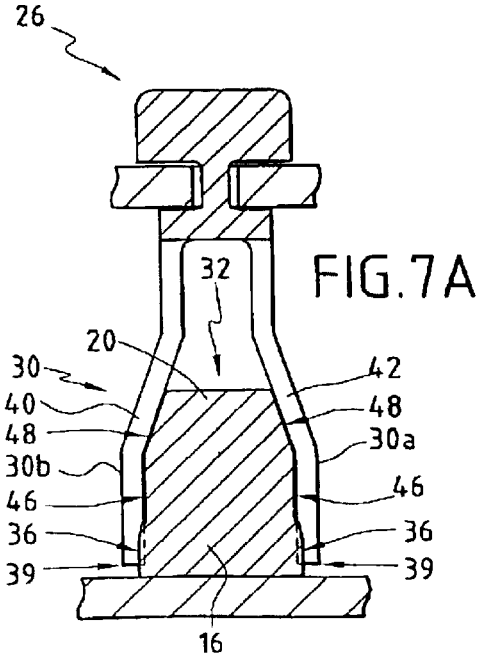
FIG. 7A is a cross-section of the device shown in FIG. 1, taken on the line VIIA—VIIA.

There is seen in FIG. 7A, the blade carrier 16 in cross-section at the level of the lugs 36, and the controllable movement means 26 whose second portion 30 coincides with the blade carrier 16 by overlapping it, in a first position of stable equilibrium. There is also seen in this figure, the inclined surfaces 48 against which the internal wall of the inclined medial portions 40, 42 bears, of the branches 30*a* and 30*b*, and their end 30 which is applied against the lateral abutment surfaces 46. In this position, as will be explained with reference to FIG. 1, the end edge 39 of the branches 30*a* and 30*b* is located facing the abutment surfaces 44 of the lugs 36. Thus, when the controllable movement means are driven, the edges of the ends 39 are applied against the abutment surfaces 44 to drive the blade carrier 16.

Figure 3:
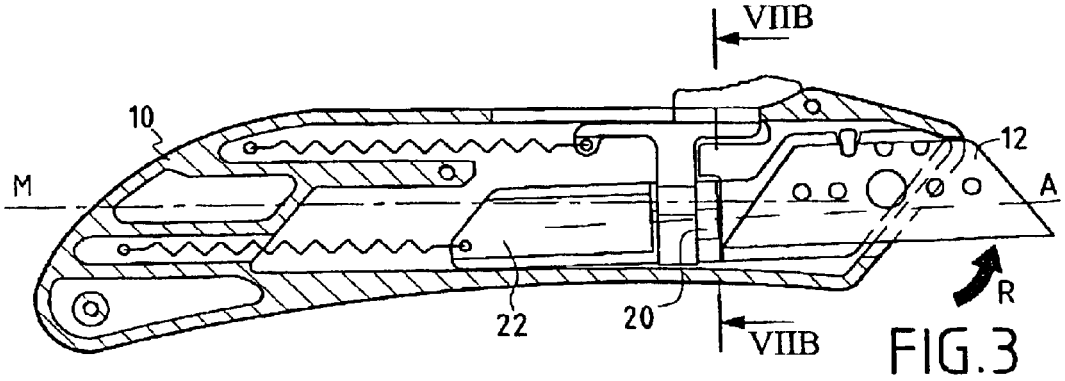
FIG. 3 is a cross-sectional view of the device shown in FIG. 1 in a second working position.
Figure 7B:
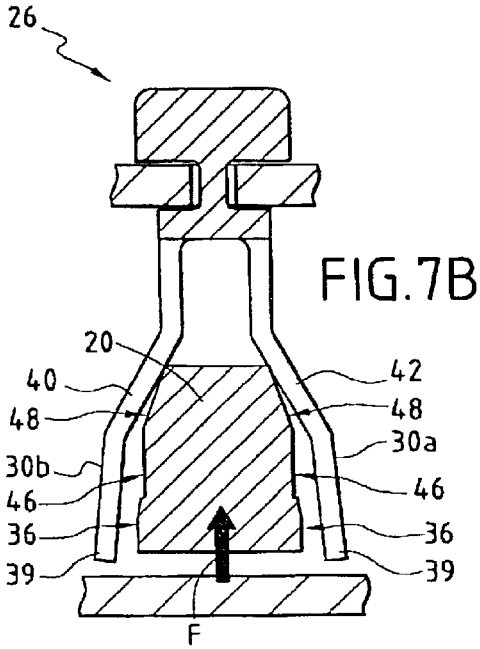
FIG. 7B is a cross-section of the device shown in FIG. 3, along the line VIIB—VIIB.

In a second position of unstable equilibrium, as shown in FIG. 7B and corresponding to a second working position according to FIG. 3, the blade carrier 16 is moved in a direction F toward the first portion 28 of the controllable movement means 26, where the two branches 30*a* and 30*b* come together.

In this way, the inclined surfaces 48 are driven against the internal walls of the intermediate inclined portions 40 and 42, and slide frictionally against them while spacing apart the branches 30*a* and 30*b* because the width of the intermediate portion 20 is constant and the fork formed by the branches 30*a* and 30*b* is flared. Thus, the end 39 of the branches 30*a* and 30*b* leaves the abutment surfaces 46 such that the end edges 39 disengage from the abutment surfaces 44 of the lugs 36 and the blockage in translation of the blade carrier 16 relative to the controllable movement means 26 is no longer ensured by the coaction of the lugs 36 and the end edges 39 of the branches 30*a* and 30*b*.

On the other hand, as will be explained, when the force F that brings together the blade carrier 16 and the controllable movement means is sufficient, the blade carrier 16 is blocked in translation by the branches 30*a* and 30*b* whose internal wall of the intermediate portions 40, 42 blocks frictionally the intermediate portion 20 and hence the longitudinal movement of the blade carrier 16.

FIG. 1 shows the cutting device according to the invention at rest. The blade carrier 16 is located in a first rest position corresponding to a position in which the blade 12 is retracted. In this position, the controllable movement means 26 are also in a rest position. And the position of the second portion 30 of the controllable movement means 26 relative to the blade carrier 16, is as shown in FIG. 7A. The ends 39 of the branches 30*a* and 30*b* are thus bearing against the lateral abutment surfaces 46 and their edge is facing the abutment surfaces 44 of the lugs 36.

Figure 2:
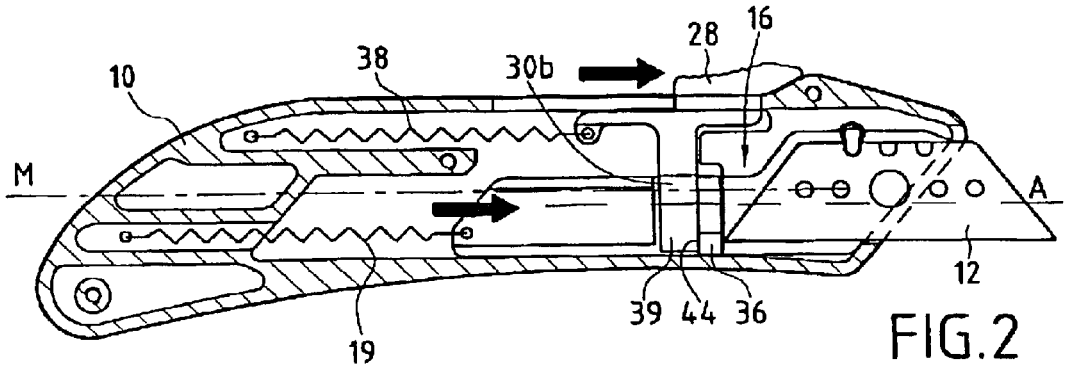
FIG. 2 is a cross-sectional view of the device shown in FIG. 1 in a first working position and a second rest position.

In this way, when the cursor 28 is driven in translation along the axis of the sleeve, as shown in FIG. 2, the edges of the ends 39 of the branches 30*a* and 30*b* bear against the abutment surfaces 44 of the lugs 36 and simultaneously drive the blade support 16 to carry it into a first working position in which the blade is outside the sleeve 10. In this position, the helicoidal springs 19, 38 are stretched and exert an isostatic return force on the blade carrier 16 and on the controllable movement means 26, which are held in position.

This first working position corresponds to a second rest position, and it is only in a second work position shown in FIG. 3 in which the blade 12 is applied against the surface to be cut, that cutting properly so called takes place.

Thus, when the blade 12 is applied against the surface to cut, a force R is exerted on it and as a result on the blade carrier 16, whose longitudinal axis A is spaced from the axis of the sleeve M. As a result, the blade carrier 16 pivots slightly relative to the second end 22 which bears against the sleeve 10 and the intermediate portion 20 of the blade carrier 16 is forced against the controllable movement means 26, still held in position, such that the branches 30*a* and 30*b* are spaced from each other as shown in FIG. 7B. Thus, the edges of the ends 39 disengage from the abutment surfaces 44 of the lugs 36 and the blade support 16 is no longer held in translation by the branches 30*a* and 30*b*. On the other hand, as has been previously explained, the internal wall of the intermediate portions 40, 42 blocks frictionally the intermediate portion 20 and hence the longitudinal movement of the blade carrier 16. In this way, during transition between the second rest position and the second working position, simultaneously, the blade carrier 16 is freed in translation by the edges of the ends 39 which coact with the lugs and blocked in translation by the inclined medial portions 40 and 42 of the branches 30*a* and 30*b*. This second working position is maintained as long as the blade 12 is held against the surface to be cut, and the cursor 28 is held in position.

Figure 4:
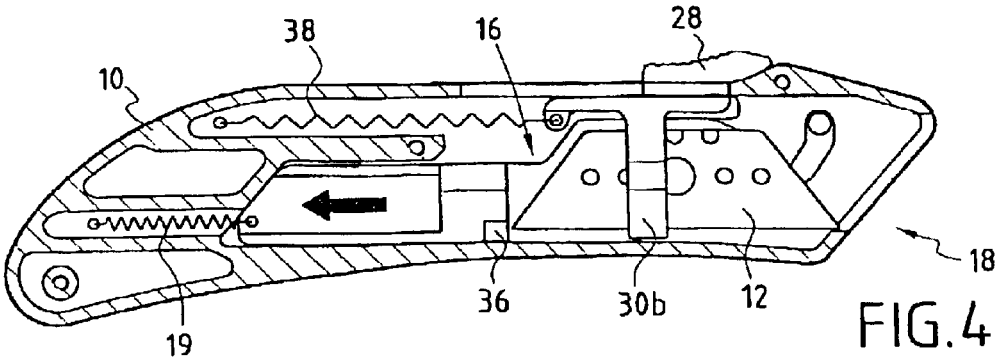
FIG. 4 is a cross-sectional view of the device shown in FIG. 1 in another rest position.

On the other hand, as soon as the blade 12 no longer bears against the surface to be cut, the blade support 16 is no longer forcibly held against the internal wall of the medial portions 40, 42, and it moves from the second working position toward a second intermediate portion because of the approach of the branches 30*a* and 30*b* toward each other. In this way, the medial portions 40, 42 no longer block the translation of the blade support 16 and the lugs 36 do not engage in the branches 30*a* and 30*b*. Thus, under the return force produced by the helicoidal spring 19, the blade support is driven into the first rest position, as shown in FIG. 4. Thus, although the cursor 28 is held in position, the blade is retracted.

The present invention is not limited to the embodiment described above. According to another particular embodiment, the blade support means have means forming a fork and the controllable movement means have a portion adapted to coact with said fork forming means, and in particular they comprise means forming a lug.

What is claimed is:

1. Cutting device with a retractable blade comprising a blade and a sleeve into which it is adapted to be retracted, characterized in that it comprises:

support means (16) for the blade (12), having means forming a drive abutment (36), adapted to slide along the axis of said sleeve (10) between a first rest position in which the blade (12) is retracted and a first working position in which the blade (12) is extended outside said sleeve (10), said support means (16) being, in said first working position, adapted to be carried from a second rest position to a second working position, spaced from the axis (M) of said sleeve (10), by passing through a second intermediate position;

a first resilient return means (19) adapted to hold said support means (16) of the blade (12) in said first rest position;

controllable movement means (26) mounted on said sleeve (10), adapted to coact with said support means (16) and to bear against said drive abutment forming means (36) to drive said support means (16) of the blade (12) from said first rest position toward said first working position;

abutment means adapted to receive said support means (16) of the blade (12) in said second working position to block them in translation;

and in that the drive of the blade (12) by means of said sleeve (10) against a surface to be cut drives said support means (16) into said second working position and effects the disengagement of said controllable movement means (26) and engages in said drive abutment forming means (36) such that said resilient return means (19) drive said support means (16) of the blade (12) into said first rest position as soon as the blade (12) is no longer in contact with said surface and that said abutment means free said support means (16) of the blade (12) which are carried from said second working position toward said second intermediate position;

characterized in that said support means (16) of the blade, have an upper portion (32) and a lower portion (34), extending longitudinally and comprising a first end (14) in which the blade (12) is held in prolongation of said support means (16) of the blade (12), an intermediate portion (20) comprising said drive abutment forming means (36) and a second end (22) for guiding said support means (16); and characterized in that said drive abutment forming means (36) are constituted by two lug forming means disposed on side surfaces of said intermediate portion (20) in its lower portion (34), opposite to each other and whose abutment surface (44) is substantially perpendicular to said support means.

2. Cutting device with a retractable blade according to claim 1, characterized in that said controllable movement means (26) have a first portion (28) projecting out of the sleeve (10) to control them, and a second portion (30) divided into two symmetrical branches (30*a*, 30*b*) facing each other, adapted to overlap said upper portion (32) at least in said intermediate portion (20) and said first end (14), the branches (30*a*, 30*b*) being adapted to bear against the abutment surfaces (44) of the lug forming means (36).

3. Cutting device with a retractable blade according to claim 2, characterized in that said branches (30*a*, 30*b*) of said second portion of said controllable movement means (26) are inclined relative to each other and relative to a plane (P) of symmetry which separates them, and in that the sidewalls (48) of said upper portion of said support means constitute frictional zones against which the branches (30*a*, 30*b*) are adapted to bear to space them from each other when said blade support means (16) are driven toward said controllable movement means (26), and to disengage from said lug forming means (36).

4. Cutting device with a retractable blade according to claim 3, characterized in that the second portion of said controllable movement means (26) between the branches (30*a*, 30*b*) of which said upper portion (32) of said support means is adapted to be engaged, constitutes said abutment means adapted to block said blade support means (16) in said second working position.

5. Cutting device with a retractable blade according to claim 1, characterized in that said first resilient return means are constituted by a helicoidal spring.

6. Cutting device with a retractable blade according to claims 1, characterized in that it moreover comprises second resilient return means adapted to hold said controllable movement means in a rest position.

7. Cutting device with a retractable blade comprising a blade and a sleeve into which it is adapted to be retracted, comprising:

support means for the blade, having means forming a drive abutment, adapted to slide along the axis of said sleeve between a first rest position in which the blade is retracted and a first working position in which the blade is extended outside said sleeve, said support means being, in said first working position, adapted to be carried from a second rest position to a second working position, spaced from the axis of said sleeve, by passing through a second intermediate position;

a first resilient return means adapted to hold said support means of the blade in said first rest position;

controllable movement means mounted on said sleeve, adapted to coact with said support means and to bear against said drive abutment forming means to drive said support means of the blade from said first rest position toward said first working position;

abutment means adapted to receive said support means of the blade in said second working position to block them in translation;

wherein the drive of the blade by means of said sleeve against a surface to be cut drives said support means into said second working position and effects the disengagement of said controllable movement means and engages in said drive abutment forming means such that said resilient return means drive said support means of the blade into said first rest position as soon as the blade is no longer in contact with said surface and that said abutment means free said support means of the blade which are carried from said second working position toward said second intermediate position;

and wherein said drive abutment forming means are constituted by two lug forming means disposed on side surfaces of an intermediate portion in its lower portion, opposite to each other and whose abutment surface is substantially perpendicular to said support means.

8. Cutting device with a retractable blade according to claim 7, wherein said support means of the blade have an upper portion and a lower portion, extending longitudinally and comprising a first end in which the blade is held in prolongation of said support means of the blade, the intermediate portion comprising said drive abutment forming means and a second end for guiding said support means.

9. Cutting device with a retractable blade according to claim 8, wherein said controllable movement means have a first portion projecting out of the sleeve to control them, and a second portion divided into two symmetrical branches facing each other, adapted to overlap said upper portion of said support means of the blade, at least in said intermediate portion and a blade holding end of said support means, said branches being adapted to bear against the abutment surfaces of a lug forming means.

10. Cutting device with a retractable blade according to claim 9, wherein said branches of said second portion of said controllable movement means are inclined relative to each other and relative to a plane of symmetry which separates them, and wherein the sidewalls of said upper portion of said support means constitute frictional zones against which the branches are adapted to bear to space them from each other when said blade support means are driven toward said controllable movement means, and to disengage from said lug forming means.

11. Cutting device with a retractable blade according to claim 10, characterized in that the second portion of said controllable movement means between the branches of which said upper portion (32) of said support means is adapted to be engaged, constitutes said abutment means adapted to block said blade support means in said second working position.

12. Cutting device with a retractable blade according to claim 7, wherein said first resilient return means are constituted by a helicoidal spring.

13. Cutting device with a retractable blade according to claim 7, further comprising second resilient return means adapted to hold said controllable movement means in a rest position.

* * * * *